US006832533B1

(12) United States Patent
Huang

(10) Patent No.: US 6,832,533 B1
(45) Date of Patent: Dec. 21, 2004

(54) TORQUE CONVERTIBLE ADAPTER FOR DRIVING TOOLS

(76) Inventor: Daniel Huang, P.O. Box 697, Feng-Yuan City, Taichung Hsien (TW), 420

( * ) Notice: Subject to any disclaimer, the term of this patent is extended or adjusted under 35 U.S.C. 154(b) by 0 days.

(21) Appl. No.: 10/629,692

(22) Filed: Jul. 30, 2003

(51) Int. Cl.[7] ..... B25B 23/157
(52) U.S. Cl. ..... 81/475; 81/467; 81/473
(58) Field of Search ..... 81/473, 474, 475, 81/476, 480, 467

(56) References Cited

U.S. PATENT DOCUMENTS 2,732,746 A * 1/1956 Livermont ..... 81/474
RE25,274 E * 10/1962 Hayes ..... 81/474
6,752,050 B2 * 6/2004 Hu ..... 81/467
6,752,051 B2 * 6/2004 Hu ..... 81/475

* cited by examiner

*Primary Examiner*—Debra S. Meislin

(57) ABSTRACT

A torque convertible adapter for driving tools includes a tubular body having an rectangular extension on rear end connected to a handle, a threaded outer periphery, a circular receiving space in front end including three pair of circular recesses in different depth spacedly formed in the bottom thereof, each pair of the circular recesses being symmetrically arranged, three pair of springs in different length and different elasticity respectively disposed into the circular recesses each having a steel ball disposed on free end, a socket spanner having an enlarged circular rear end inserted into the circular receiving space including a plurality of semi-circular recesses engaged with the steel balls, a bolt rotatably secured the socket spanner in the circular receiving space through a central hole in the enlarged circular rear end and the bottom of the circular receiving space, a ring pad sleeved on the socket spanner an a U-shaped cap fastened to the tubular body having a threaded inner periphery engaged with the threaded outer periphery and a central bore for passing through the socket spanner which is protruded out of the adapter.

5 Claims, 6 Drawing Sheets

TORQUE CONVERTIBLE ADAPTER FOR DRIVING TOOLS

BACKGROUND OF THE INVENTION

The present invention relates to household tools and more particularly to a torque convertible adapter for driving tools.

As we know that a screwdriver and/or a socket spanner are indispensable for a family, a factory or a skilled worker. Generally, a screwdriver or a socket spanner is fixed to a handle. But some of them have a ratchet disposed therein in order to facilitate rotation to provide more convenient to the users.

Conventional torque screwdriver and/or a torque socket spanner include a spring to create elasticity to intensify their torque. But the torque could not be adjusted. Furthermore, the producer of the tools still follows the ratchet type to improve the driving tools. Therefore, no any evolution.

SUMMARY OF THE PRESENT INVENTION

The present invention has a main object to provide a torque convertible adapter which has a multi-stage automatically torque convertible structure that gradually intensifies its torque so as adaptable to a screwdriver or a socket spanner.

Another object of the present invention is to provide a torque convertible adapter for driving tools which has a swivel cap for adjusting the torque of the socket spanner and provide a simple and convenient structure to assemble and to operate.

Accordingly, the torque convertible adapter for driving tools of the present invention comprises generally a tubular body connected to a handle through a rectangular extension including a threaded outer periphery and a plurality of circular recesses in different depth spacedly formed around the bottom for respectively disposing a plurality of springs in different intensity of torques, a steel ball disposed at the outer end of each of the springs and respectively engaged within a plurality of semi-circular recesses in the bottom of the enlarged circular end of a socket spanner which is inserted into tubular body and secured by a screw through the screw holes in the center of the enlarged circular end and bottom of the tubular body, a ring pad sleeved onto the socket spanner and a U-shaped cap which has threads on inner periphery engaged with the threaded outer periphery of the tubular body and a central bore for permitting the socket spanner passing through to protrude outside of the adapter.

When uses the adapter to fasten a hexagon headed screw, the spring provides different intensity of torques to obtain the torque convertible purposes.

The present invention will become more fully understood by reference to the following detailed description thereof when read in conjunction with the attached drawings.

DETAILED DESCRIPTION OF THE PREFERRED EMBODIMENT

Figure 1:
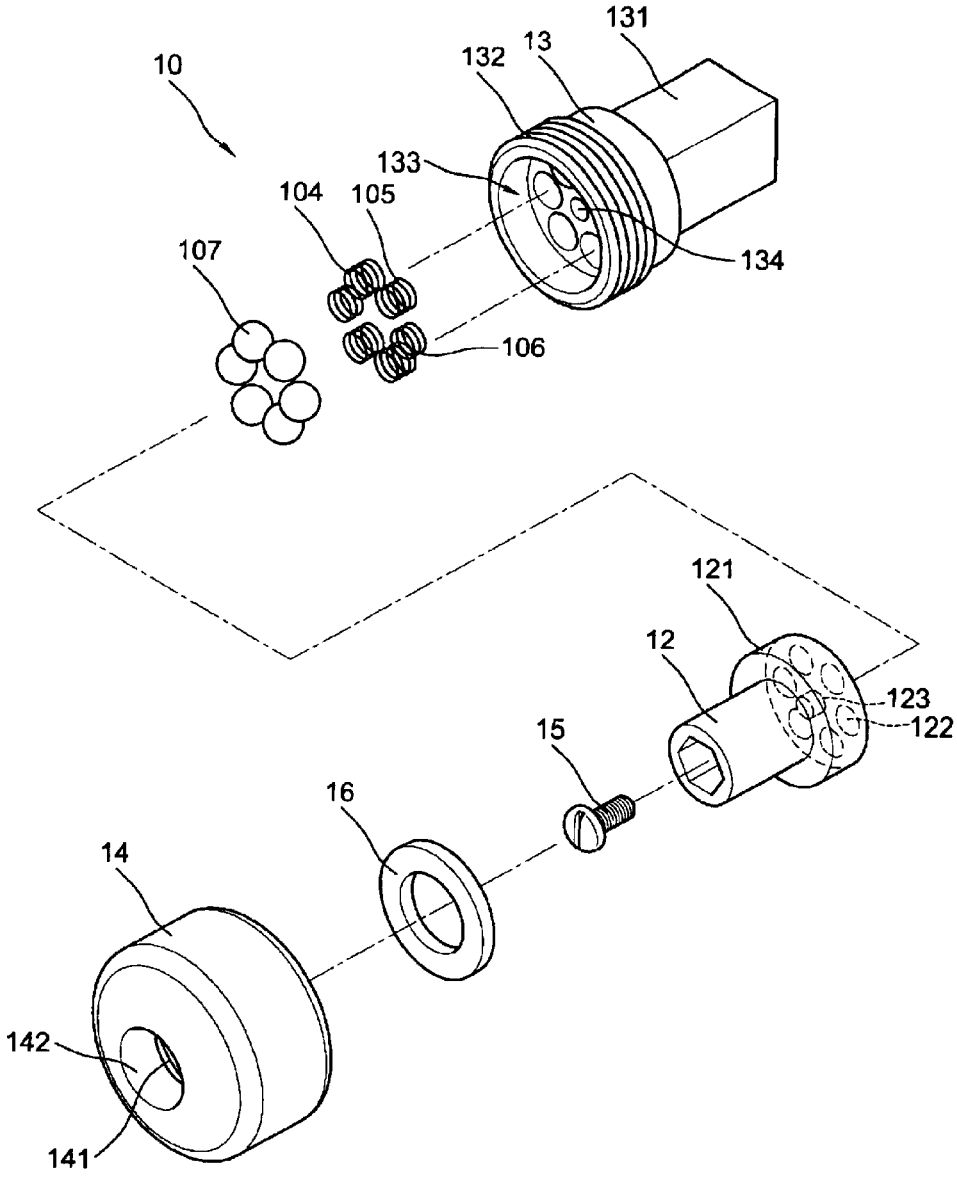
FIG. 1 is an exploded perspective view to show a torque convertible adapter of a preferred embodiment of the present invention.
Figure 2:
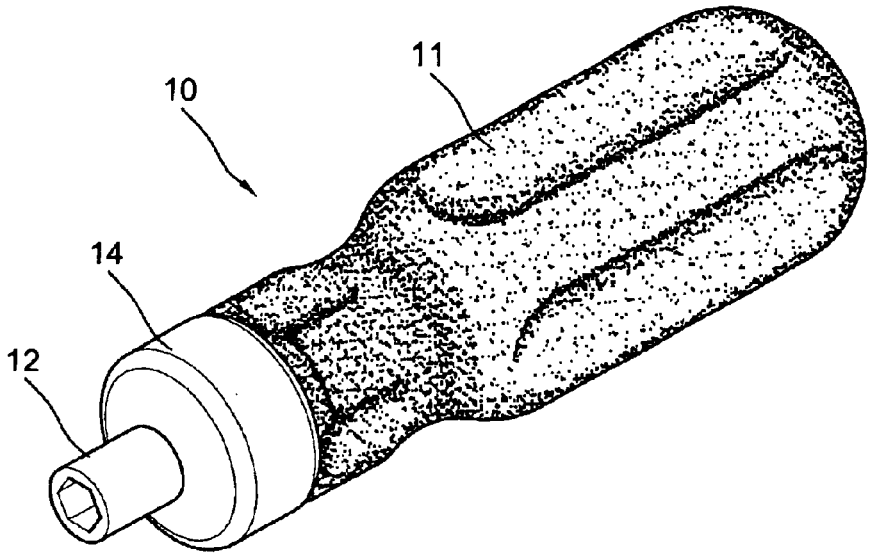
FIG. 2 is a perspective view to show the assembly of FIG. 1.
Figure 3:
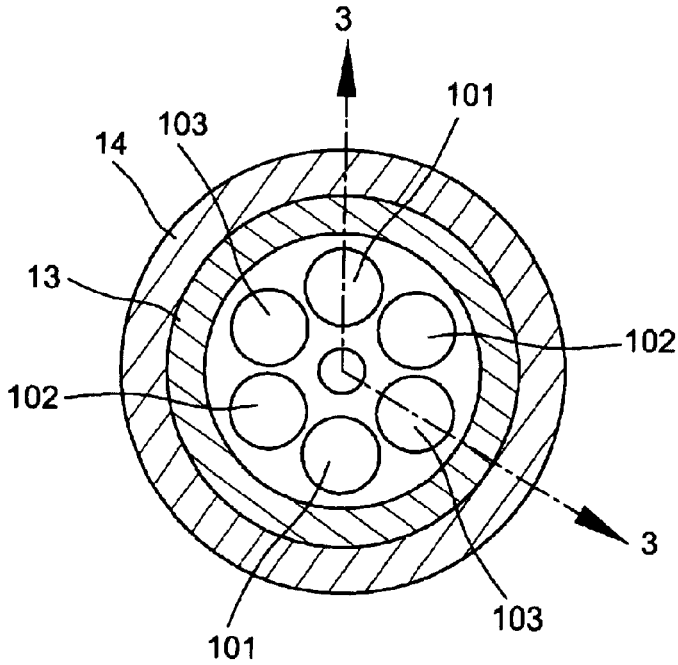
FIG. 3 is a sectional view to show the inner arrangement of the adapter of the present invention.
Figure 4:
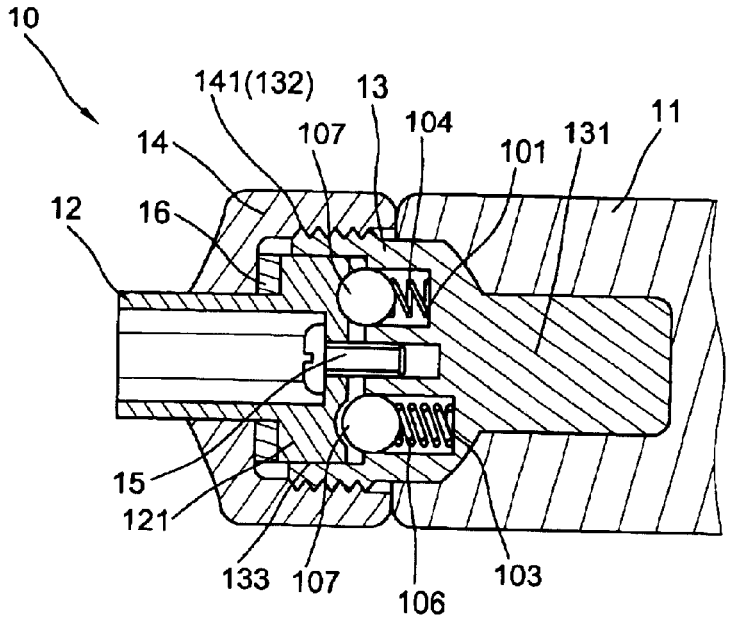
FIG. 4 is a sectional view taken along line 3—3 of FIG. 3.

A typical embodiment of the disclosure of the present invention is illustrated in FIGS. 1, 2 and 3, the torque convertible adapter 10 for driving tools comprises a tubular body 13 which has a rectangular extension 131 on rear end connected to a handle 11, a threaded outer periphery 132, a circular receiving space 133 in front end, in the bottom of which is three pairs of circular recesses 101, 102 and 103 in different depth and each pair of the circular recesses are positioned symmetrical with each other. For example, the first pair of the circular recesses 101 are shallow, the second pair of the circular recesses 102 are deeper than that of the first pair 101 and the third pair of circular recesses 103 are deeper than that of the second pair 103, a screw hole 134 in the central bottom of the tubular body 13, three pair of springs 104, 105 and 106 in different elastic intensity and different length respectively engaged into the three pairs of recesses 101, 102 and 103 each having a steel ball 107 at their outer ends, a socket spanner 12 having an enlarged circular end 121 inserted into the circular receiving space 133 having six semi-circular recesses 122 and a through hole 123 at center respectively engaged with the steel balls 107 and the screw hole 134 of the tubular body 13, a screw 15 rotatably fastens the socket spanner 12 on the bottom of the tubular body 13 through the hole 123 and the screw hole 134, a ring pad 16 sleeved onto the outer periphery of the socket spanner 12 and a U-shaped cap 14 having threads 141 on inner periphery engaged with the threads on outer periphery of the tubular body 13 (as shown in FIG. 4) and a central ball 142 for permitting the socket spanner 12 passing through and protruding out of the adapter 10.

In operation, rotate the handle 11 actuating the socket spanner 12 to fasten a working piece such as a hexagonal screw, suppose the torque value required to fasten the screw is A, the steel ball 17 under the elasticity of the first pair of springs 104 create a torque value is A'>A. The socket spanner 12 is stable and rotated together with the tubular body 13 and handle 11. If the torque value required is larger than A' that the pair of first springs 104 could not bear torque, then the second pair of springs 105 are functioned in cooperation with the first pair of springs 104 that a greater elasticity will be created to finished job.

Figure 5:
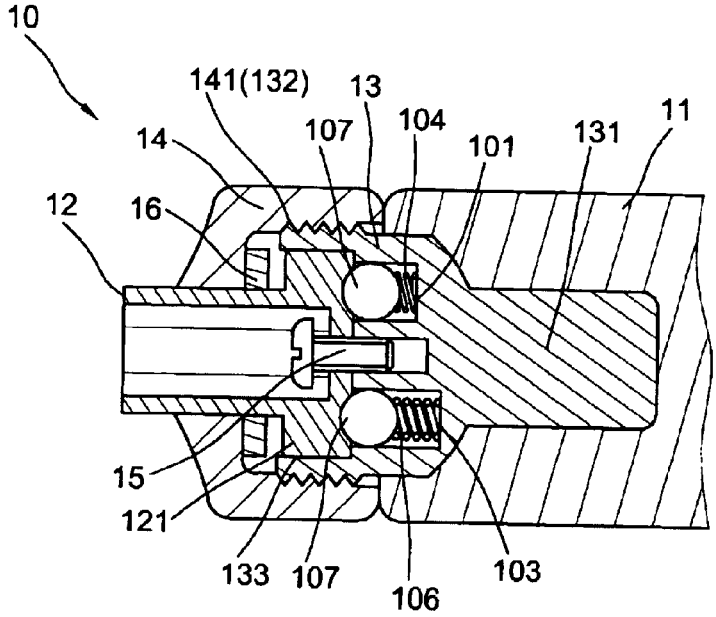
FIG. 5 is a sectional view indicating that the enlarged circular end of the socket spanner slides out of the first and second springs and stops against the third springs.
Figure 6:
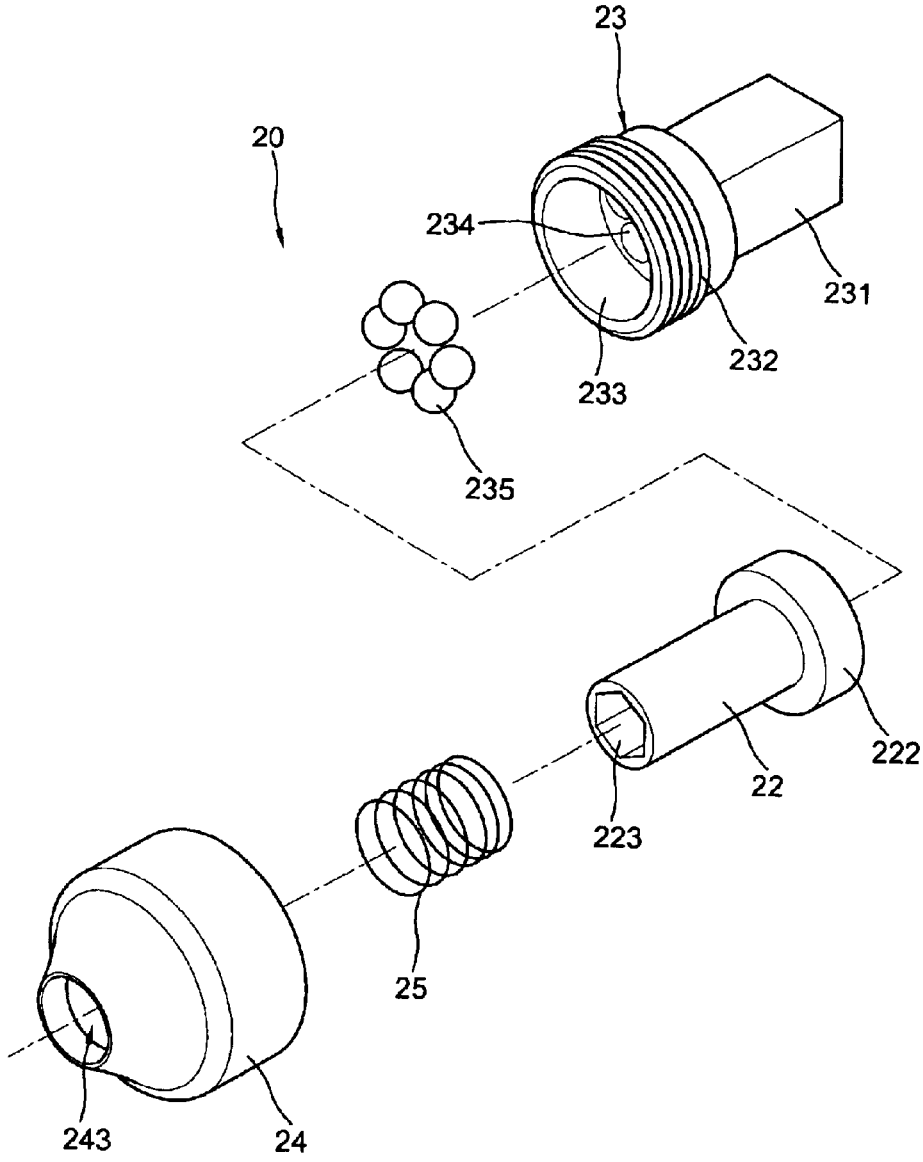
FIG. 6 is an exploded perspective view to show an alternate embodiment of the adapter of the present invention.
Figure 7:
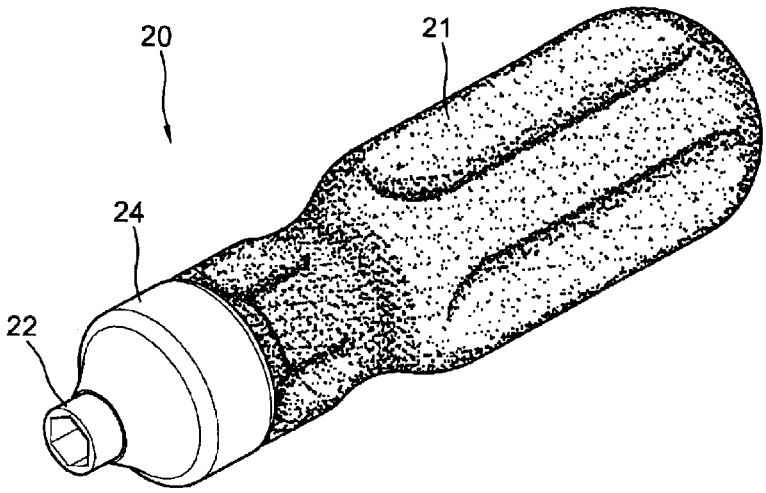
FIG. 7 is a perspective view to show the assembly of FIG. 6.
Figure 8:
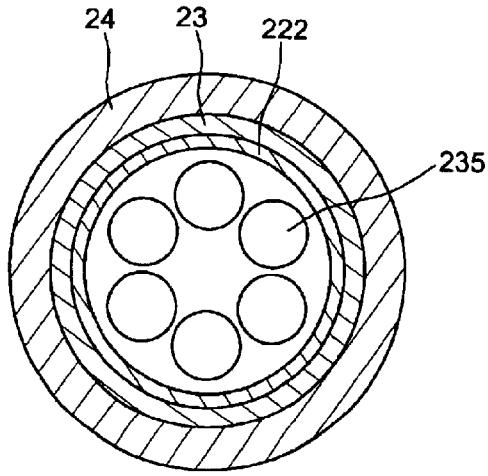
FIG. 8 is a sectional view to show the inner arrangement of the adapter of the present invention.
Figure 9:
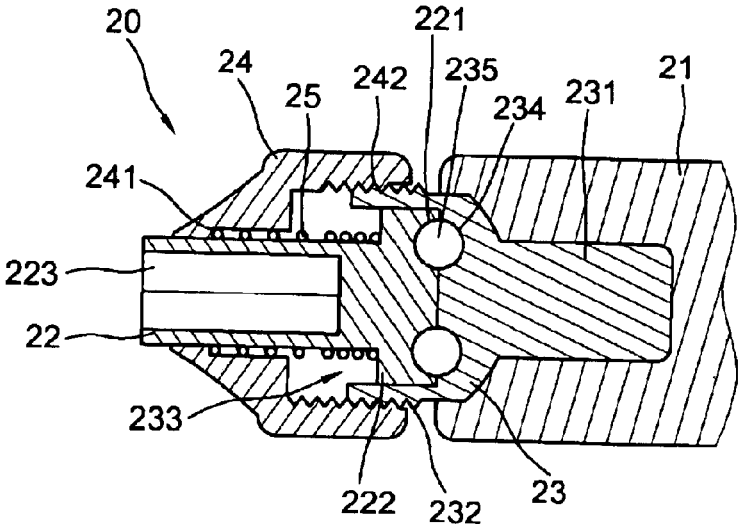
FIG. 9 is a longitudinal section of FIG. 6.

If a working piece requires a greatest torque value, the enlarged circular end 121 of the socket spanner will slide out the steel balls on the first and second pairs of springs 104 and 105, and moves deeper into the circular receiving space 133, the third pair of springs 106 begin to act together with the first and second pairs of springs 104 and 105 to provide greatest elasticity to fasten the working piece (as shown in FIG. 5).

Based the above discussed structure and function, the circular recesses 101, 102 and 103 may be increased more the three pairs to intensify the torque value and the socket spanner 12 may be replaced with a shank of a screwdriver or an allen wrench.

Referring to FIGS. 6 to 9 of the drawings, an alternate embodiment of the torque convertible adapter of the present invention is provided. This adapter 20 comprises a tubular body 23 having a rectangular extension 231 on rear end for connected the tubular body 23 to a handle 21. The tubular body 23 has threads on outer periphery, a circular receiving space 233 in front end and a plurality of first semi-circular recesses 234 spacedly formed around the inner bottom for respectively disposing a plurality of steel balls 235 therein. A socket spanner 22 has an enlarged circular rear end inserted into the circular receiving space 233 of the tubular body including a plurality of second semi-circular recesses 221 in outer bottom engaged with the outer portion of the steel balls 235, and a hexagonal opening in front end, a spring 25 sleeved onto the outer periphery of the socket spanner 22. A U-shaped cap 24 fastens to the outer periphery of the tubular body 23 has a threaded inner periphery 242 engaged with threads 232, an annular shoulder 241 formed on a inner periphery for stopping against the front end of the spring 25 and a central bore 243 in front end for permitting the socket spanner passing through and protruding out of the adapter 20.

When fastens a working piece, the socket spanner 22 has to bear a certain torque value. If the second semi-circular recesses 221 of the enlarged circular end 222 under the pressure of the spring 25 not slide out of the steel balls, it proves that the torque value of the socket spanner 22 is greater than torque value it bears. If the socket spanner bears the torque value greater than that it has, the second semi-circular recesses 221 will slide out of the steel balls 235. So that the socket spanner 22 is in the state of idling.

Meanwhile, the operator may gradually rotate the cap 24 clockwise to intensify the elasticity of the spring 25 to press the enlarged circular end 222 moving inward in order to prevent the second semi-circular recesses 221 from sliding out the steel balls 235. This non-step torque value adjustment provides greater convenience for the user to operate and assemble the adapter 20.

Figure 10:
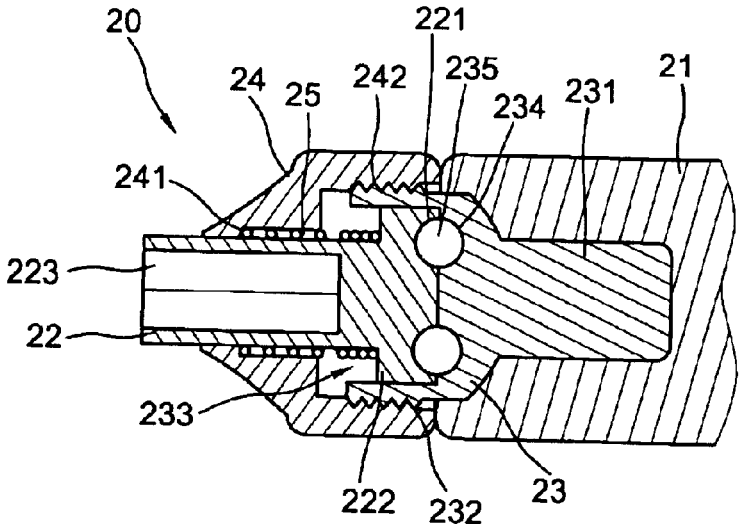
FIG. 10 is a longitudinal section indicating that the is fastened inward to intensify the torque of the adapter.

FIG. 10 show that the cap 24 is moved to an inmost position and contacted the rim of the tubular body.

Note that the specification relating to the above embodiment should be construed as exemplary rather than as limitative of the present invention, with many variations and modifications being readily attainable by a person of average skill in the art without departing from the spirit or scope thereof as defined by the appended claims and their legal equivalents.

I claim:

1. A torque convertible adapter for driving tools comprising:

a tubular body having a rectangular extension on rear end connecting to a handle, a circular receiving space in front end, a threaded outer periphery, a screw hole centrally form in a bottom of said circular receiving space and three pairs of circular recesses in different depth spacedly formed around the bottom of said circular receiving space, said each pair of circular recesses being symmetrically arranged;

three pairs of spring means in different length and different elasticity respectively engaged within said corresponding circular recesses of said tubular body and each having a steel ball disposed on outer end thereof;

a socket spanner having an enlarged circular rear end inserted into the circular receiving space of said tubular body, said enlarged circular rear end having six semi-circular recesses spacedly formed circumference engaged with said steel balls respectively and a through hole in a center thereof engageable with the screw hole of said tubular body;

a bolt rotabably fastening said socket spanner into the circular receiving space of said tubular body through said through hole and said screw hole;

a ring pad sleeved onto an outer periphery of said socket spanner; and a U-shaped cap engaged with said tubular body having a threaded inner periphery engaged with the threaded outer periphery of said tubular body and a central bore for permitting said socket spanner passing through and protruding out of said adapter.

2. The torque convertible adapter as recited in claim 1 wherein said socket spanner may be replaced with a shank of a screwdriver and an allen wrench.

3. The torque convertible adapter as recited in claim 1 wherein said pair of circular recesses may be increased in number.

4. A torque convertible adapter for driving tools comprising:

a tubular body having a rectangular extension on rear end connecting to a handle, a circular receiving space in front end, a thread outer periphery and a plurality of first semi-circular recesses spacedly formed around bottom thereof for respectively disposing a plurality of steel balls;

a socket spanner having an enlarged circular rear end inserted into the circular receiving space of said tubular body and a hexagonal opening in front end, said enlarged circular rear end having a plurality of second semi-circular recesses spacedly formed around outer bottom engaged with outer portion of said steel balls;

a spring means sleeve onto an outer periphery of said socket spanner; and a U-shaped cap fastened to outer periphery of said tubular body having a threaded inner periphery engaged with the threaded outer periphery of said tubular body, an annular shoulder formed in an inner periphery wall for stopping against front end of said spring means and a central bore in front end for permitting said socket spanner passing through and protruding out of said adapter.

5. The torque convertible adapter as recited in claim 4 said adapter is a non-step torque convertible structure.

* * * * *